US005909849A

United States Patent [19]

Yamasaki et al.

[11] Patent Number: 5,909,849

[45] Date of Patent: Jun. 8, 1999

[54] ROTARY ATOMIZING ELECTROSTATIC COATING APPARATUS

[75] Inventors: Isamu Yamasaki, Toyota; Ichio Tomita, Aichi-ken; Kengo Honma, Tokai; Sinichi Takahashi, Toyota, all of Japan

[73] Assignee: Toyota Jidosha Kabushiki Kaisha, Toyota, Japan

[21] Appl. No.: 08/784,906

[22] Filed: Jan. 16, 1997

[30] Foreign Application Priority Data

Jan. 19, 1996 [JP] Japan ..... 8-007264

[51] Int. Cl.[6] ..... B05B 5/00

[52] U.S. Cl. ..... 239/700; 239/708; 239/224

[58] Field of Search ..... 239/223, 224, 239/699, 700, 701, 702, 703, 708, 104, 106, 112

[56] References Cited

U.S. PATENT DOCUMENTS

| | | | |
|---|---|---|---|
| 4,919,333 | 4/1990 | Weinstein | 239/223 |
| 4,943,005 | 7/1990 | Weinstein | 239/223 |
| 5,078,321 | 1/1992 | Davis et al. | 239/224 |
| 5,137,215 | 8/1992 | Degli | 239/223 |
| 5,346,139 | 9/1994 | Davis et al. | 239/703 |
| 5,474,236 | 12/1995 | Davis et al. | 239/703 |
| 5,676,756 | 10/1997 | Murate et al. | 118/629 |
| 5,707,009 | 1/1998 | Schneider | 239/112 |

FOREIGN PATENT DOCUMENTS

| | | | |
|---|---|---|---|
| 032391 | 7/1981 | European Pat. Off. . | |
| 369573 | 5/1990 | European Pat. Off. . | |
| 3711127 | 10/1988 | Germany | 239/703 |
| 6-134354 | 5/1994 | Japan . | |
| 6-210205 | 8/1994 | Japan . | |

*Primary Examiner*—Andres Kashnikow
*Assistant Examiner*—Lisa Ann Douglas
*Attorney, Agent, or Firm*—Pillsbury MAdison & Sutro LLP

[57] ABSTRACT

A rotary atomizing electrostatic coating apparatus includes an atomizing head having bores for self-cleaning the atomizing head, a center nozzle, and surrounding nozzle or nozzles. In the apparatus, an intersection of paint expelled from the paint nozzle or nozzles with the rear surface of the hub is offset from the rear openings of the bores.

6 Claims, 3 Drawing Sheets

ROTARY ATOMIZING ELECTROSTATIC COATING APPARATUS

This application is based on Japanese Patent Application HEI 8-7264 filed in Japan on Jan. 19, 1996, the content of which is incorporated into the present application by reference.

BACKGROUND OF THE INVENTION

1. Field of the Invention

The present invention relates to a rotary atomizing electrostatic coating apparatus having a plurality of paint feed nozzles per rotary atomizing head, called multi-feed nozzle-type coating apparatus.

2. Description of Related Art

Japanese Patent Publication No. HEI 6-134354 disclosed a multi-feed, nozzle-type rotary atomizing electrostatic coating apparatus.

In the apparatus, as illustrated in FIGS. 6 and 7, a paint feed nozzle assembly 21 for feeding paint to a rotary atomizing head 25 is disposed within a thinner feed nozzle 24. The nozzle assembly 21 includes a center nozzle 22 disposed on an axis of rotation of the rotary atomizing head 25 and a plurality of surrounding nozzles 23 arranged around the center nozzle 22. The rotary atomizing head 25 includes a central portion (or hub) having a self-cleaning bore 26 for letting thinner from the thinner nozzle 24 pass therethrough to self-clean a front surface of the atomizing head 25.

When a color of a current paint is changed, feeding the current color paint from a current paint feed nozzle is stopped, then thinner is fed through the thinner tube 24 to clean the atomizing head 25. After cleaning is completed, feeding of the thinner is stopped, and then feeding paint of another color through another paint feed nozzle is started.

However, in the conventional apparatus, because a paint injection pattern from the surrounding paint nozzles 23 interferes with the self-cleaning bore 26, the paint expelled from the surrounding nozzles 23 at a high speed during metallic top coating enters the self-cleaning bore 26 at a high speed and passes through the self-cleaning bore 26. Because a centrifugal force does not act on the passing paint, the passing paint flows straight ahead to collide with a workpiece to be coated and causes a coating problem.

SUMMARY OF THE INVENTION

An object of the present invention is to provide a rotary atomizing electrostatic coating apparatus which can prevent paint from passing through a self-cleaning bore and thus prevent the paint from flowing straight ahead.

The above-described object can be achieved by providing a rotary atomizing electrostatic coating apparatus according to the present invention which includes a rotary atomizing head having a plurality of self-cleaning bores formed in a hub of the atomizing head and a paint feed nozzle assembly including a center nozzle and at least one surrounding nozzle disposed around the center nozzle. In the apparatus, an intersection of paint expelled from the paint feed nozzle assembly with a rear surface of the hub opposing the paint feed nozzle assembly is offset from rear openings of the bores formed in the hub. More particularly, the surrounding nozzle has a front end having an inside surface, and an intersection of a frontward projection of the inside surface of the front end of the surrounding nozzle with the rear surface of the hub does not interfere with the rear openings of the bores formed in the hub.

Preferably, the front end of the surrounding nozzle is bent so that the frontward projection of the front end of the surrounding nozzle is directed radially outside a circle connecting respective centers of the rear openings of the self-cleaning bores. More particularly, the front end of the surrounding nozzle is bent so that the intersection of the frontward projection of the inside surface of the surrounding nozzle with the rear surface of the hub is spaced from and is radially outside the circle.

Preferably, the surrounding nozzle is straight and is provided at the front end thereof with a member having a hole inclined with respect to an axis of the straight surrounding nozzle (parallel to an axis of rotation of the rotary atomizing head).

Preferably, the surrounding nozzle and the central nozzle are straight, and the rear openings of the self-cleaning bores are located radially between the intersection of the paint expelled from the surrounding nozzle with the rear surface of the hub and the intersection of the paint expelled from the center nozzle with the rear surface of the hub. More particularly, the rear openings of the self-cleaning bores are located radially between the intersection of the frontward projection of the inside surface of the front end of the surrounding nozzle with the rear surface of the hub and the intersection of the frontward projection of the inside surface of the front end of the center nozzle with the rear surface of the hub.

Preferably, the surrounding nozzle is straight, and the rear openings of the self-cleaning bores are located radially outside an intersection of the paint expelled from the surrounding nozzle with the rear surface of the hub. More particularly, the rear openings of the self-cleaning bores are located radially outside the intersection of the frontward projection of the inside surface of the front end of each the surrounding nozzle with the rear surface of the hub.

In any of the above-described apparatus, because the intersection of the paint expelled from the paint feed nozzle assembly with the rear surface of the hub is offset from the rear openings of the self-cleaning bores, the paint expelled from the paint feed nozzle assembly does not enter the self-cleaning bores, so that the paint expelled from the paint feed nozzle assembly will not pass the self-cleaning bores and flow straight ahead.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 1:
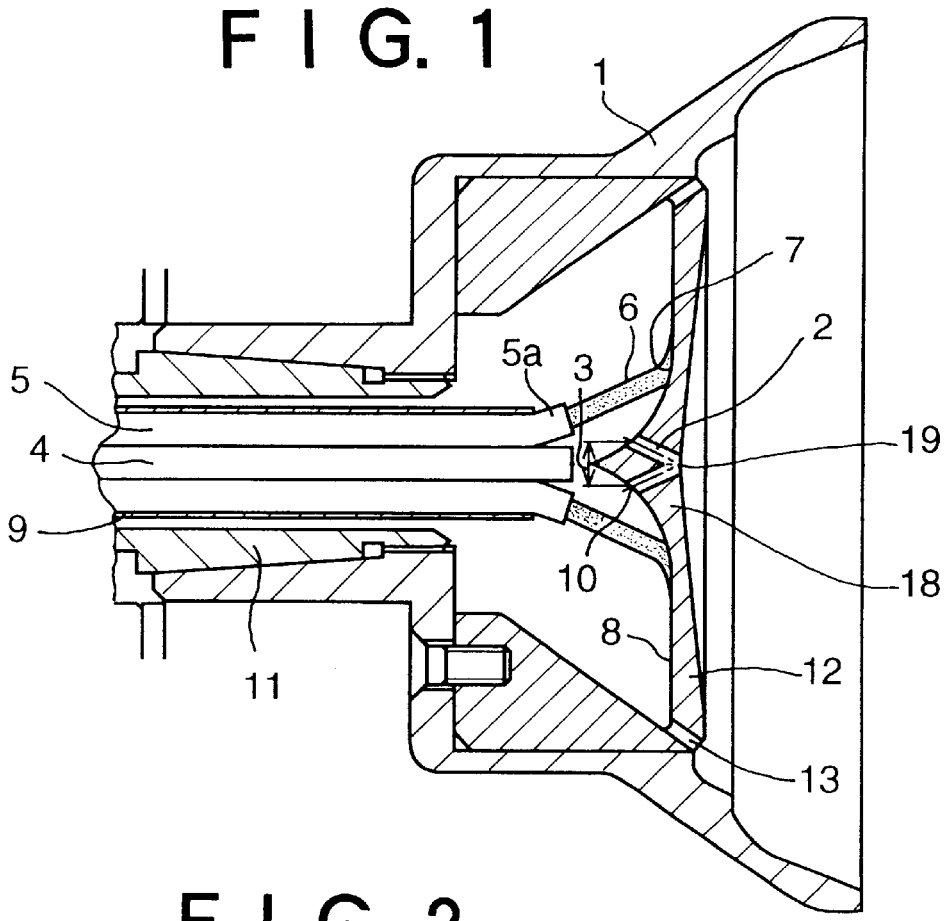
FIG. 1 is a cross-sectional view of a portion of a rotary atomizing electrostatic coating apparatus according to a first embodiment of the present invention.

FIGS. 1, 2, 3, 4 and 5 illustrate a rotary atomizing electrostatic coating apparatus according to a first, second, third, and fourth embodiments of the present invention, respectively. Portions common or similar to all of the embodiments of the present invention are denoted with the same reference numerals throughout all of the embodiments of the present invention.

First, portions common or similar to all of the embodiments of the present invention will be explained with reference to, for example, FIG. 1.

As illustrated in FIG. 1, a rotary atomizing electrostatic coating apparatus according to any embodiment of the present invention includes a rotary atomizing head 1 and a paint feed nozzle assembly for feeding paint to the atomizing head 1.

The rotary atomizing head 1 is a bell type and is coupled to a hollow shaft 11 rotatably supported by a body via an air bearing (not shown). The atomizing head 1 is driven by an air turbine (not shown) together with the hollow shaft 11 at a high speed.

The paint feed nozzle assembly is stationary to the body. The paint feed nozzle assembly includes a center nozzle 4 disposed on and coaxially with an axis of rotation of the atomizing head 1 and at least one (usually, a plurality of) surrounding nozzle or nozzles 5 (hereinafter, nozzles) disposed around the center nozzle 4. The center nozzle 4 and surrounding nozzles 5 constitute a multi-feed nozzle assembly. The center and surrounding nozzles 4 and 5 are connected to respective color paint sources via hoses and valves. The paint feed nozzle assembly extends through a thinner feed nozzle 9 which is mounted stationary with respect to the body. In this instance, all of the paint nozzles 4 and 5 may extend through a single thinner nozzle 9 as shown in FIG. 1, or each paint nozzle 4, 5 may extend through a respective one of a plurality of thinner nozzles. The thinner nozzle 9 is connected to a thinner source via a hose and a valve. The stationary paint feed nozzles 4 and 5 and thinner nozzle 9 are disposed within the rotatable hollow shaft 11 and extend through the hollow shaft 11.

The rotary atomizing head 1 includes a bell portion, a hub 18, and a disk portion 12 connecting the bell portion and the hub 18. The hub 18 is located in front of the paint feed nozzle assembly and axially opposes the paint feed nozzle assembly. Many holes 13 for letting paint pass therethrough are formed at a radially outer portion of the disk portion 12, and a plurality of bores 2 are formed in the hub 18 for letting a portion of thinner pass therethrough when self-cleaning the atomizing head 1 is conducted. The self-cleaning bores 2 have rear openings 10 which open at a rear surface 8 of the hub 18. Centers of the openings 10 are located on a circle 3 and are radially spaced from the axis of rotation of the atomizing head 1. The circle 3 has its center at the axis of rotation of the head 1. The bores 2 extend from the rear openings 10 axially frontwardly and radially inwardly and collect at a front end of the bores 2 to form a single front opening 19 open at a front end of the hub 18 and which is coaxial with the axis of rotation of the atomizing head 1. The rear surface 8 of the hub 18 is substantially conical and protrudes rearwardly, i.e., toward the paint feed nozzle assembly. The conical rear surface 8 has a sharp tip at its center.

An intersection 7 of paint 6 expelled from the surrounding nozzle or nozzles 5 with the rear surface 8 of the hub 18 is offset from the rear openings 10 of the self-cleaning bores 2 which open at the rear surface 8 in a radial direction of the atomizing head 1. More particularly, an intersection 7 of a frontward projection of an inside surface of a front end 5*a* of each of the surrounding nozzle or nozzles 5 with the rear surface 8 of the hub 18 is offset from the rear openings 10 of the bores 2.

Ways for offsetting the intersection 7 from the rear openings 10 are different with respective embodiments of the present invention as explained hereinafter.

Operation and effects due to the above-described common or similar portions will be further explained.

During painting, paint is fed through at least one of the paint feed nozzles 4 and 5 to the atomizing head 1. The paint collides with the rear surface 8, then flows radially outwardly along the surface 8, then passes through the holes 13 to the inside surface of the bell portion, and finally flows radially outwardly from a front end of the bell portion, electrostatically charged and centrifugally biased. The paint is blown ahead by shaping air and arrives at a surface of a workpiece to form a coating thereon.

When the instant paint is changed to another paint of a different color, feeding the paint of the current color through the current paint nozzle is stopped by closing the valve installed in the hose connected to the current paint nozzle. Then, thinner is fed to the atomizing head 1 through the thinner nozzle 9 to clean the atomizing head 1. A portion of the thinner passes through the self-cleaning bores 2 and cleans the front surface of the hub 18 and the disk portion 12 of the atomizing head 1. Then, feeding of the thinner is stopped, and the feeding of another paint of another color through another paint nozzle is begun to conduct the next painting operation.

During the above-described painting operation, the paint 6 expelled from the surrounding nozzle or nozzles 5 collides with the rear surface 8 of the hub 18 at the intersection 7. Since the intersection 7 is offset from the rear openings 10 of the self-cleaning bores 2, the paint does not enter the bores 2 directly, so that the paint 6 is prevented from passing through the bores 2 and flowing straight ahead. As a result, collision of a solid flow of paint with the workpiece does not occur and thus, a painting trouble will not occur.

Next, portions unique to each embodiment of the present invention will be explained.

With a first embodiment of the present invention, as illustrated in FIG. 1, the front end 5*a* of each of the surrounding nozzle or nozzles 5 is bent so that the intersection of the inside surface of the front end 5*a* of each of the nozzle or nozzles 5 with the rear surface 8 of the hub 18 is radially outside the circle 3 connecting the centers of the rear openings 10 of them bores 2. Thus, the intersection 7 of the paint 6 expelled from each of the surrounding nozzle or nozzles 5 with the rear surface 8 does not interfere with the rear openings 10 of the bores 2.

With the operation or effects of the first embodiment of the present invention, since the front end of each of the surrounding nozzle or nozzles 5 is bent radially outwardly for offsetting the intersection 7 from the rear openings 10, a pitch circle diameter of the nozzle or nozzles 5 and a diameter of the thinner nozzle 9 do not need to be increased, so that the structure for preventing paint from passing through the self-cleaning bores 2 is not accompanied by an increase in size of the rotary atomizing electrostatic coating apparatus.

Figure 2:
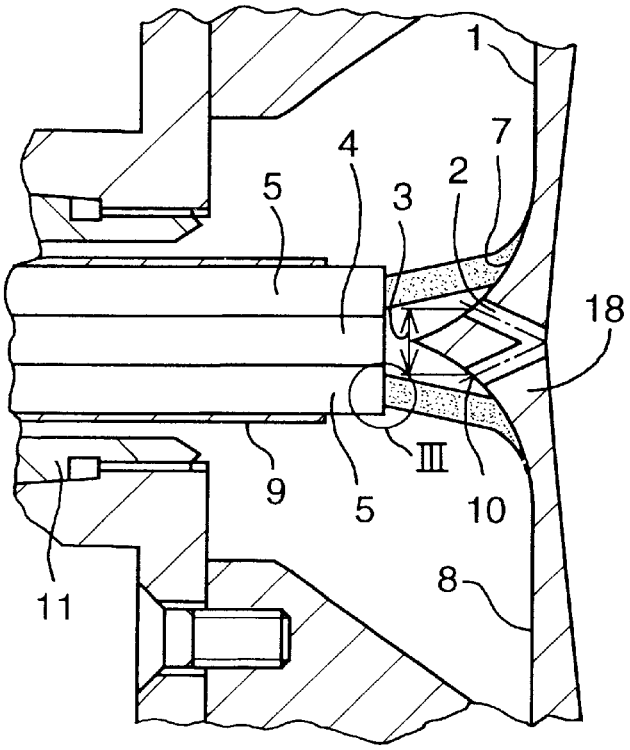
FIG. 2 is a cross-sectional view of a portion of a rotary atomizing electrostatic coating apparatus according to a second embodiment of the present invention.
Figure 3:
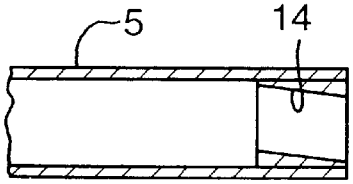
FIG. 3 is an enlarged cross-sectional view of portion III, of the apparatus of FIG. 2.

With a second embodiment of the present invention, as illustrated in FIGS. 2 and 3, each of the surrounding nozzle or nozzles 5 is straight including a front end thereof. Each surrounding nozzle 5 has a member or plug 14 at the front end of the nozzle 5. The member 14 includes a hole formed therein, and an inside surface of the hole constitutes the inside surface of the front end of the surrounding nozzle 5. The hole has an axis inclined from the axis of the surrounding nozzle 5 parallel to the axis of rotation of the atomizing head and directed axially frontwardly and radially outwardly. Thus, the intersection 7 of the paint 6 expelled from the hole of the member 14 provided to each of the surrounding nozzle or nozzles 5 with the rear surface 8 does not interfere with the rear openings 10 of the bores 2.

With the operation or effects of the second embodiment of the present invention, since the front end of each of the surrounding nozzle or nozzles 5 is provided with the member 14 having the oblique hole for offsetting the intersection 7 from the rear openings 10, a pitch circle diameter of the nozzle or nozzles 5 and a diameter of the thinner nozzle 9 do not need to be increased, so that the structure for preventing paint from passing through the self-cleaning bores 2 is not accompanied by an increase in size of the rotary atomizing electrostatic coating apparatus.

Figure 4:
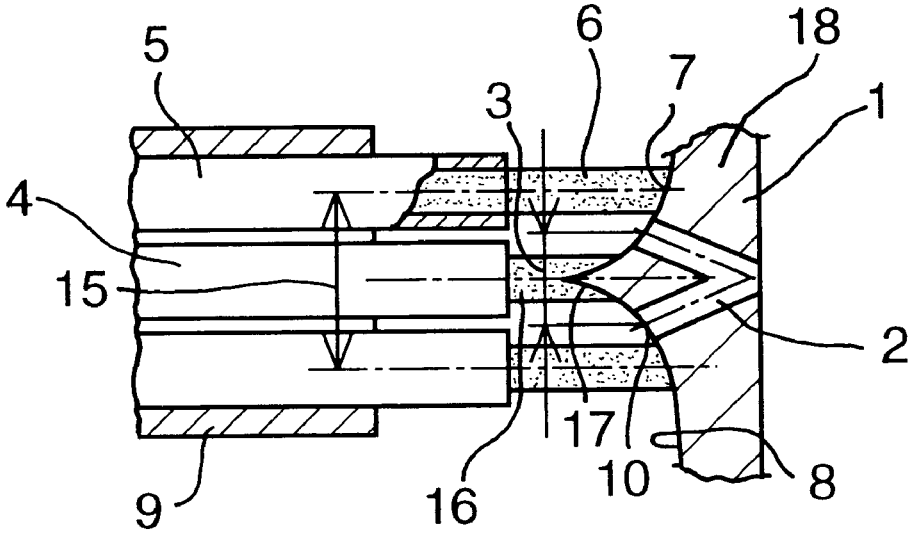
FIG. 4 is a cross-sectional view of a portion of a rotary atomizing electrostatic coating apparatus according to a third embodiment of the present invention.

With a third embodiment of the present invention, as illustrated in FIG. 4, the center nozzle 4 and the surrounding nozzle or nozzles 5 are straight and extend parallel to the axis of rotation of the atomizing head 1. A diameter of the circle 3 connecting the centers of the rear openings 10 and a pitch circle diameter 15 of the surrounding nozzle or nozzles 5 are determined so that the rear openings 10 are located radially between the intersection 7 of the frontward projection of the inside surface of the front end of each of the surrounding nozzle or nozzles 5 with the rear surface 8 of the hub 12 and an intersection 17 of the frontward projection of the inside surface of the front end of the center nozzle 4 with the rear surface 8 of the hub 18. Thus, the rear openings 10 are located radially between the intersection 7 of the paint 6 expelled from each of the surrounding nozzle or nozzles 5 with the rear surface 8 and the intersection 17 of the paint 16 expelled from the center nozzle 4 with the rear surface 8, so that the intersection 7 and 17 do not interfere with the rear openings 10 of the bores 2.

With the operation or effects of the third embodiment of the present invention, since the pitch circle diameter 15 of the surrounding nozzle or nozzles 5 and the pitch circle diameter 3 of the rear openings 10 are determined so that the intersections 7 and 17 do not interfere with the openings 10, the structure for preventing paint from passing through the self-cleaning bores 2 is not accompanied by the work of bending the front ends of the surrounding nozzles 5 or inserting the member 14 into the front ends of the surrounding nozzles 5.

Figure 5:
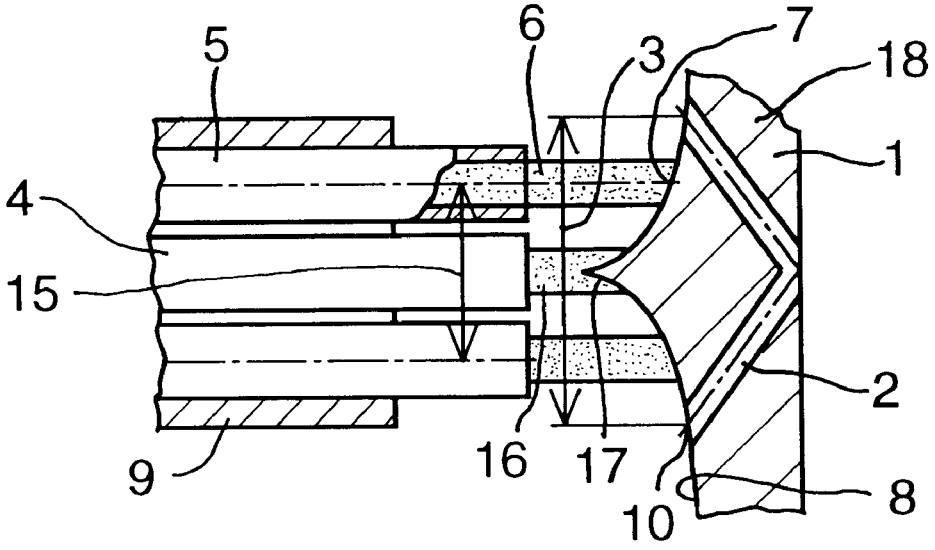
FIG. 5 is a cross-sectional view of a portion of a rotary atomizing electrostatic coating apparatus according to a fourth embodiment of the present invention.
Figure 6:
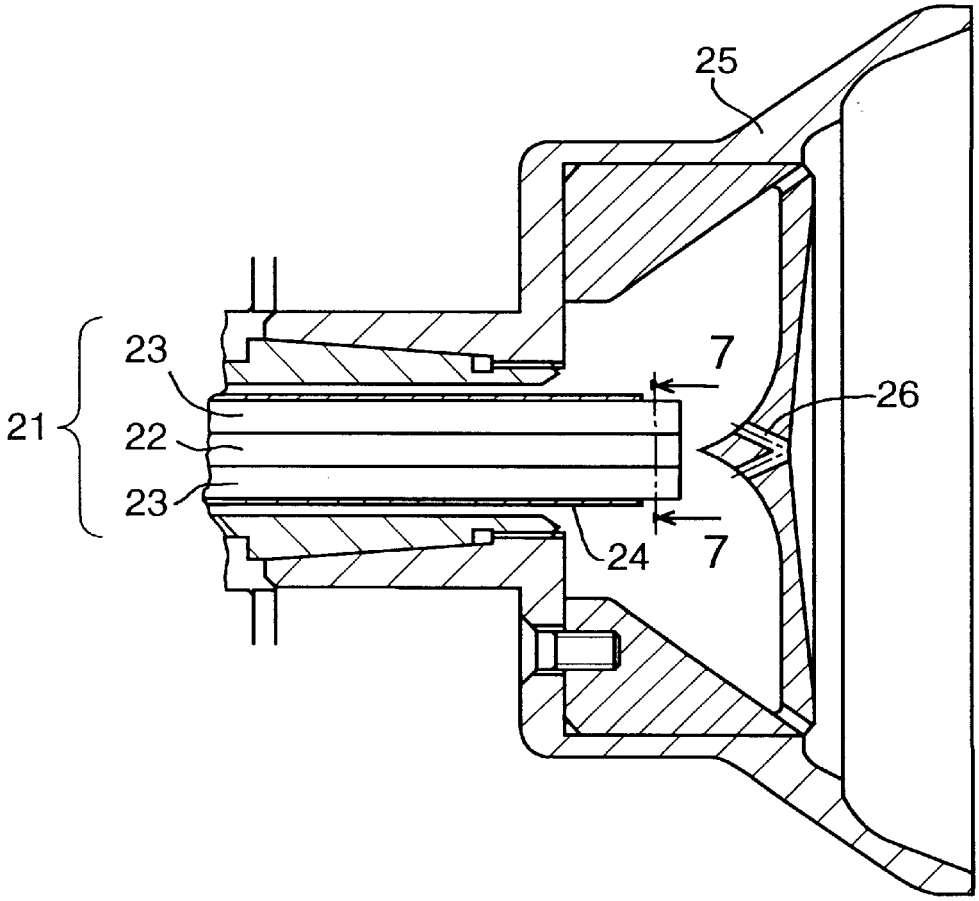
FIG. 6 PRIOR ART
FIG. 6 is a cross-sectional view of a portion of a conventional rotary atomizing electrostatic coating apparatus.
Figure 7:
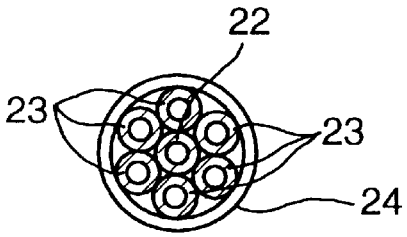
FIG. 7 PRIOR ART
FIG. 7 is a cross-sectional view of the apparatus FIG. 6 taken along line 7—7 of FIG. 6.

With a fourth embodiment of the present invention, as illustrated in FIG. 5, the center nozzle 4 and the surrounding nozzle or nozzles 5 are straight and extend parallel to the axis of rotation of the atomizing head 1. A diameter of the circle 3 connecting the centers of the rear openings 10 and a pitch circle diameter 15 of the surrounding nozzle or nozzles 5 are determined so that the rear openings 10 are radially outside the intersection 7 of the frontward projection of the inside surface of the front end of each of the surrounding nozzle or nozzles 5 with the rear surface 8 of the hub 18. Thus, the rear openings 10 are located radially outside the intersection 7 of the paint 6 expelled from each of the surrounding nozzle or nozzles 5 with the rear surface 8, so that the intersection 7 and the intersection 17 of the paint 16 from the center nozzle 4 with the rear surface 8 do not interfere with the rear openings 10 of the bores 2.

With the operation or effects of the fourth embodiment of the present invention, since the pitch circle diameter 15 of the surrounding nozzle or nozzles 5 and the pitch circle diameter 3 of the rear openings 10 are determined so that the intersection 7 does not interfere with the openings 10, the structure for preventing paint from passing through the self-cleaning bores 2 is not accompanied by the work of bending the front ends of the surrounding nozzles 5 or inserting the member 14 into the front ends of the surrounding nozzles 5. Further, even if the paint expelled from the center nozzle 4 and the paint expelled from the surrounding nozzle or nozzles 5 interfere with each other, the interfering paint does not enter the rear openings 10 of the bores 2.

According to any embodiment of the present invention, the following technical advantage is obtained:

Since the intersection 7 of the paint expelled from the surrounding nozzle or nozzles 5 with the rear surface 8 of the hub 12 is offset from the rear openings 10 of the bores 2, the paint expelled from the paint nozzles 4 and 5 is prevented from passing through the bores 2 and will not flow straight ahead in the form of a solid flow.

Although the present invention has been described with reference to specific exemplary embodiments, it will be appreciated by those skilled in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. A rotary atomizing electrostatic coating apparatus comprising:

a rotary atomizing head including an axis of rotation, said rotary atomizing head including a hub having a front surface and a rear surface, said rear surface being substantially conical and protruding rearwardly, said hub having a plurality of bores formed therein for self-cleaning said rotary atomizing head by permitting thinner to pass therethrough when cleaning is conducted, said plurality of bores having a plurality of respective rear openings open at said rear surface of said hub and located on a circle having a circle center at said axis of rotation of said atomizing head; and a paint feed nozzle assembly including a center nozzle disposed on said axis of rotation of said rotary atomizing head and at least one surrounding nozzle disposed generally adjacent said center nozzle, said center nozzle including a front end having an inside surface, said at least one surrounding nozzle each including a front end having an inside surface, wherein an intersection of a frontward projection of said inside surface of said front end of each said at least one surrounding nozzle with said rear surface of said hub is offset from said rear openings of said plurality of bores.

2. An apparatus according to claim 1, wherein said plurality of bores extend axially frontwardly and radially inwardly from said plurality of rear openings and join at front ends thereof to form a single front opening which open at said front surface of said hub.

3. An apparatus according to claim 1, wherein said front end of each said at least one surrounding nozzle is bent so that said intersection of said frontward projection of said inside surface of said front end of each said at least one surrounding nozzle with said rear surface of said hub is radially outside said circle on which said rear openings of said bores are disposed.

4. An apparatus according to claim 1, wherein said at least one surrounding nozzle is straight and has a member at a front end thereof, said member including a hole formed therein, an inside surface of said member constitutes said inside surface of said front end of said at least one surrounding nozzle, said hole having an axis inclined from said axis of rotation of said rotary atomizing head and directed axially frontwardly and radially outwardly.

5. An apparatus according to claim 1, wherein said at least one surrounding nozzle and said center nozzle are straight, and wherein said plurality of rear openings of said bores formed in said hub are located radially between said intersection of said frontward projection of said inside surface of said front end of each said at least one surrounding nozzle with said rear surface of said hub and an intersection of a frontward projection of said inside surface of said front end of said center nozzle with said rear surface of said hub.

6. An apparatus according to claim 1, wherein said at least one surrounding nozzle is straight, and said plurality of rear openings of said bores in said hub is located radially outside said intersection of said frontward projection of said inside surface of said front end of each said at least one surrounding nozzle with said rear surface of said hub.

* * * * *